US006658972B1

(12) United States Patent
Burke

(10) Patent No.: US 6,658,972 B1
(45) Date of Patent: Dec. 9, 2003

(54) FULL FORCE WEB SEVERER

(75) Inventor: David Charles Burke, Portsmouth, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/339,725

(22) Filed: Jun. 24, 1999

(51) Int. Cl.[7] ..... B26D 5/12

(52) U.S. Cl. ..... 83/13; 83/639.1; 60/409; 60/428; 60/429; 100/269.14

(58) Field of Search ..... 83/639.1, 582, 83/586, 587, 590, 639.4, 13; 60/409, 428, 429; 91/DIG. 2, 321, 417 R, 449, 450, 451, 452; 100/269.05, 269.08, 269.14, 269.16; 173/1, 114, 206, 207, 212

(56) References Cited

U.S. PATENT DOCUMENTS

| | | | | | |
|---|---|---|---|---|---|
| 1,833,216 | A | * | 11/1931 | Hanna | 91/DIG. 2 |
| 3,094,043 | A | * | 6/1963 | Powers et al. | 137/516.15 |
| 3,170,379 | A | * | 2/1965 | Dempster | 91/519 |
| 3,267,677 | A | * | 8/1966 | Bollar | 173/1 |
| 3,340,756 | A | * | 9/1967 | Mize | 83/320 |
| 3,429,227 | A | * | 2/1969 | Stanworth | 91/321 |
| 3,735,823 | A | * | 5/1973 | Terada | 173/204 |
| 3,796,050 | A | * | 3/1974 | Fisk et al. | 60/413 |
| 3,805,652 | A | * | 4/1974 | LaLonde et al. | 83/639.7 |
| 3,872,934 | A | * | 3/1975 | Terada | 173/207 |
| 3,925,985 | A | * | 12/1975 | Peterson | 91/321 |
| 4,022,096 | A | * | 5/1977 | Forichon | 83/639.1 |
| 4,116,122 | A | * | 9/1978 | Linder et al. | 100/269.14 |
| 4,173,171 | A | * | 11/1979 | Lange | 91/417 A |
| 4,246,820 | A | * | 1/1981 | Dahms | 83/639.1 |
| 4,249,436 | A | * | 2/1981 | Clay | 83/639.1 |
| 4,290,592 | A | | 9/1981 | Kastner | |
| 4,295,411 | A | * | 10/1981 | Grantmyre et al. | 91/321 |
| 4,462,418 | A | * | 7/1984 | Xander | 137/106 |
| 4,534,250 | A | * | 8/1985 | Garrocho | 83/639.1 |
| 4,541,565 | A | * | 9/1985 | Deimerly et al. | 239/747 |
| 4,699,031 | A | | 10/1987 | D'Angelo et al. | |
| 4,827,820 | A | * | 5/1989 | Kinnunen | 83/587 |
| 4,982,638 | A | * | 1/1991 | Brussel | 83/639.1 |
| 5,377,964 | A | | 1/1995 | Haller | |
| 5,522,212 | A | * | 6/1996 | Kubik | 60/428 |
| 5,568,754 | A | * | 10/1996 | Chun | 83/639.1 |
| 5,765,462 | A | * | 6/1998 | Mannio | 83/639.1 |
| 5,857,401 | A | * | 1/1999 | Corves et al. | 91/DIG. 2 |
| 6,050,172 | A | * | 4/2000 | Corves et al. | 91/DIG. 2 |
| 6,095,184 | A | * | 8/2000 | Neff et al. | 137/115.21 |
| 6,293,175 | B1 | * | 9/2001 | Enwald et al. | 83/639.1 |

FOREIGN PATENT DOCUMENTS

| | | | |
|---|---|---|---|
| DE | 2133511 | * | 6/1973 |
| EP | 0 739 695 A2 | | 10/1996 |

OTHER PUBLICATIONS

International Publication No. WO 98/55688 (Enwald et al.), dated Dec. 10, 1998.

* cited by examiner

*Primary Examiner*—Stephen Choi
(74) *Attorney, Agent, or Firm*—Laurence A. Greenberg; Werner H. Stemer; Ralph E. Locher

(57) ABSTRACT

A first given pressure is provided to a first side of an air pressure cylinder that in turn drives a cutting member under the influence of the first given pressure. A second given pressure is provided to a second side of the air pressure cylinder that is greater than the first given pressure during a non-cutting state of the air cylinder. The cutting member remains stationary as long as the second given pressure is greater than the first given pressure. To transition to a cutting state, the second given pressure is rapidly reduced to a value below the first given pressure value during a cutting state of the air pressure cylinder for moving the cutting member to cut a web.

14 Claims, 4 Drawing Sheets

FULL FORCE WEB SEVERER

BACKGROUND OF THE INVENTION

1. Field of the Invention

The invention relates, generally, to a web severer and more specifically, to a speed enhanced full force web severer.

2. Description of the Related Art

In current web severer configurations, an air cylinder is used to move a severing knife into and through a web or ribbon in a folder. To accomplish this act, the air pressure must be evacuated from one side of the air cylinder and introduced into the other side of the air cylinder. In doing so, the knife begins to move as the pressure builds up in the air cylinder.

The length of time required to sever the web is most critical. Since printing presses operate at speeds in excess of 15.25 meters per second, the severer must complete its function in a fraction of a second. One of the time critical limitations in the severing process is the time necessary to build up to maximum air pressure in the air cylinder. The pressure build up time thus controls the severing time. In addition, most severer assemblies begin to move as soon as air is introduced into the air cylinder (i.e. 5 pounds), and the knife contacts the web before the air cylinder reaches maximum air pressure. When the knife hits the web before achieving full force, the web can drag on the knife before the web is severed. Samples taken from various folders have exhibited several feet of knife dragging marks before the knife severed the web.

Attempts to eliminate these deficiencies have led to many innovations. It is common to add a quick dump valve to the appropriate side of the air cylinder to evacuate air faster during the cutting process. This allows the cutting member to start its acceleration sooner. Another solution involves a reduction in the web severer assembly mass that allows for faster acceleration of the knife. A further solution involves the installation of an air reservoir close to the air cylinder for allowing a faster pressure build up in the air cylinder. Still another solution involves the installation of a valve with a high Cv value that results in a faster build up in the air cylinder. A still further solution involves the installation of air lines having large air lines. The larger air lines allows a faster pressure build up in the air cylinder. Finally, optimization of the angle at which the knife attempts to shear the web has led to more efficient severing. All of these enhancements have led to incremental improvements in web severing. However, the ever increasing web speeds now require even faster severing times than is available with the above mentioned improvements by themselves or in combination.

SUMMARY OF THE INVENTION

It is accordingly an object of the invention to provide a full force web severer which overcome the hereinmentioned disadvantages of the heretofore-known devices and methods of this general type, in which the time for severing webs is reduced and the severer contacts the web with the maximum available force.

With the foregoing and other objects in view there is provided, in accordance with the invention, a method for severing a web, which includes:

a) providing a first given pressure to a first side of an air pressure cylinder driving a cutting member;

b) providing a second given pressure to a second side of the air pressure cylinder that is greater than the first given pressure during a non-cutting state of the air cylinder, the cutting member remaining stationary as long as the second given pressure being greater than the first given pressure; and c) reducing rapidly the second given pressure to below the first given pressure during a cutting state of the air pressure cylinder for moving the cutting member to sever a web.

In accordance with an added feature of the invention, there is the step of repeating steps b) and c) for each severing operation.

In accordance with another feature of the invention, there is the step of providing a control unit outputting control signals received by the air cylinder for controlling the first given pressure and the second given pressure and for transitioning between the cutting state and the non-cutting state.

In accordance with an addition feature of the invention, there are the steps of: using a first valve for providing the first given pressure and a second valve for providing the second given pressure; and controlling the first valve and the second valve via the control signals output by the control unit.

In accordance with a further added feature of the invention, there is the step of providing three-way valves as the first valve and the second valve.

In accordance with a further additional feature of the invention, the first given pressure is in a range of 70–75 psi and the second given pressure is greater than or equal to 90 psi in the non-cutting state.

In accordance with a concomitant feature of the invention, there is the step of using a quick exhaust valve for rapidly reducing the second given pressure during step c). The pressure is preferably reduced to near 0 psi as soon as possible.

Other characteristic features of the invention are set forth in the appended claims.

Although the invention is illustrated and described herein as embodied in a full force web severer, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
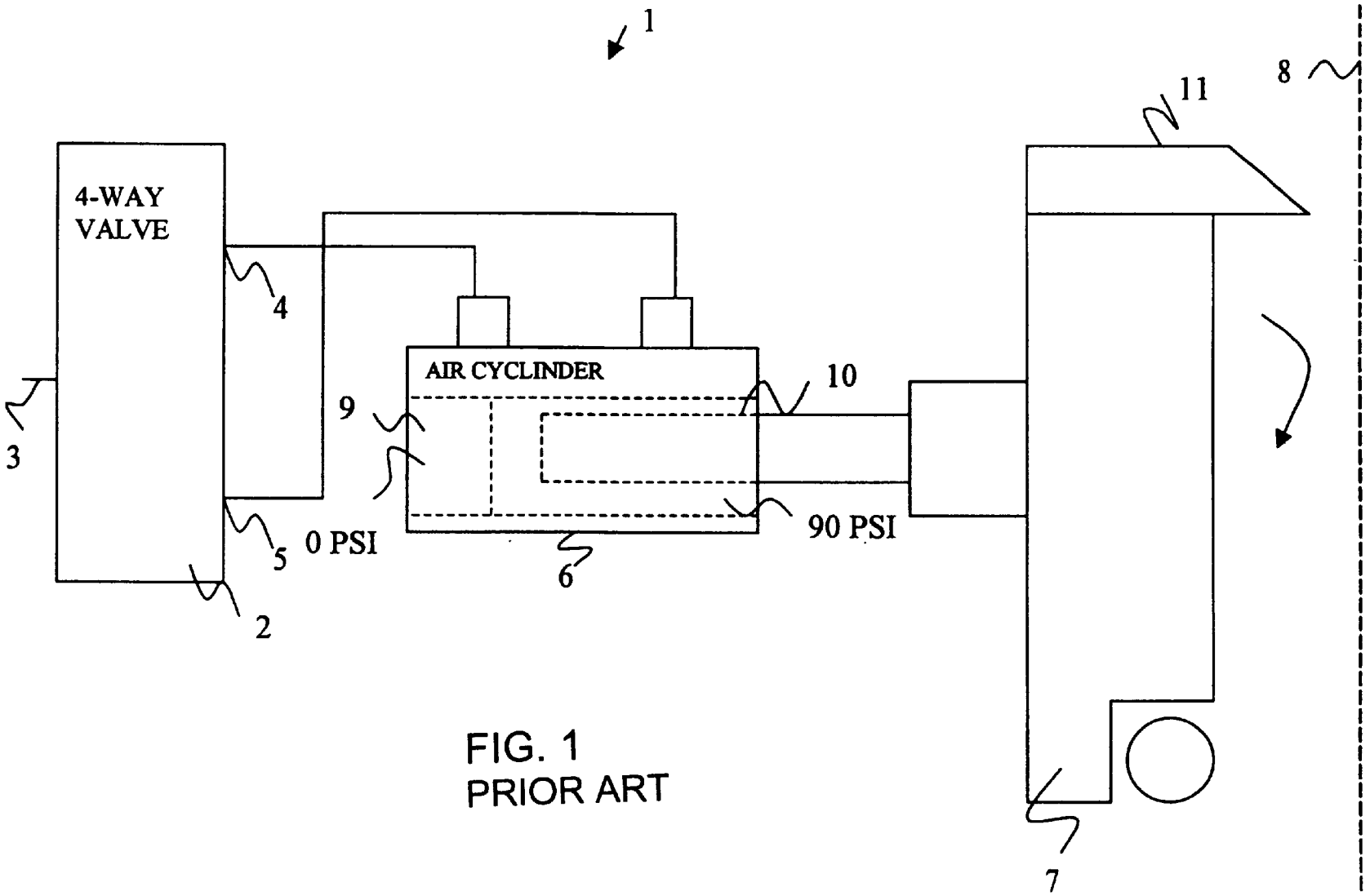
FIG. 1 PRIOR ART
FIG. 1 a diagrammatic block diagram of a prior art web severer.

In all the figures of the drawing, sub-features and integral parts that correspond to one another bear the same reference symbol in each case. Referring now to the figures of the drawings in detail and first, particularly, to FIG. 1 thereof, there is shown a prior art severer assembly 1 containing a four-way valve 2 with an air pressure inlet 3, a first air pressure outlet 4 and a second air pressure inlet/outlet 5. The first air pressure outlet 4 and the second air pressure inlet/outlet 5 fluidically communicate with an air cylinder 6 for introducing air pressure on a first side 9 and a second side 10 of the air cylinder 6. Initially, the second side 10 of the air cylinder is held at 90 psi while the first side 9 is held at 0 psi. In this state the severer assembly 1 is in a non-cutting state and a cutting member 7 is held stationary. In the cutting state, the air pressure (i.e. the 90 psi) is evacuated from the second side 10 of the air cylinder 6 and air pressure is built up in the first side 9 of the air cylinder 6 from 0 psi to 70–90 psi. As the air pressure builds up, the air cylinder 6 moves the cutting member 7 that contacts and cuts a web 8.

Figure 2:
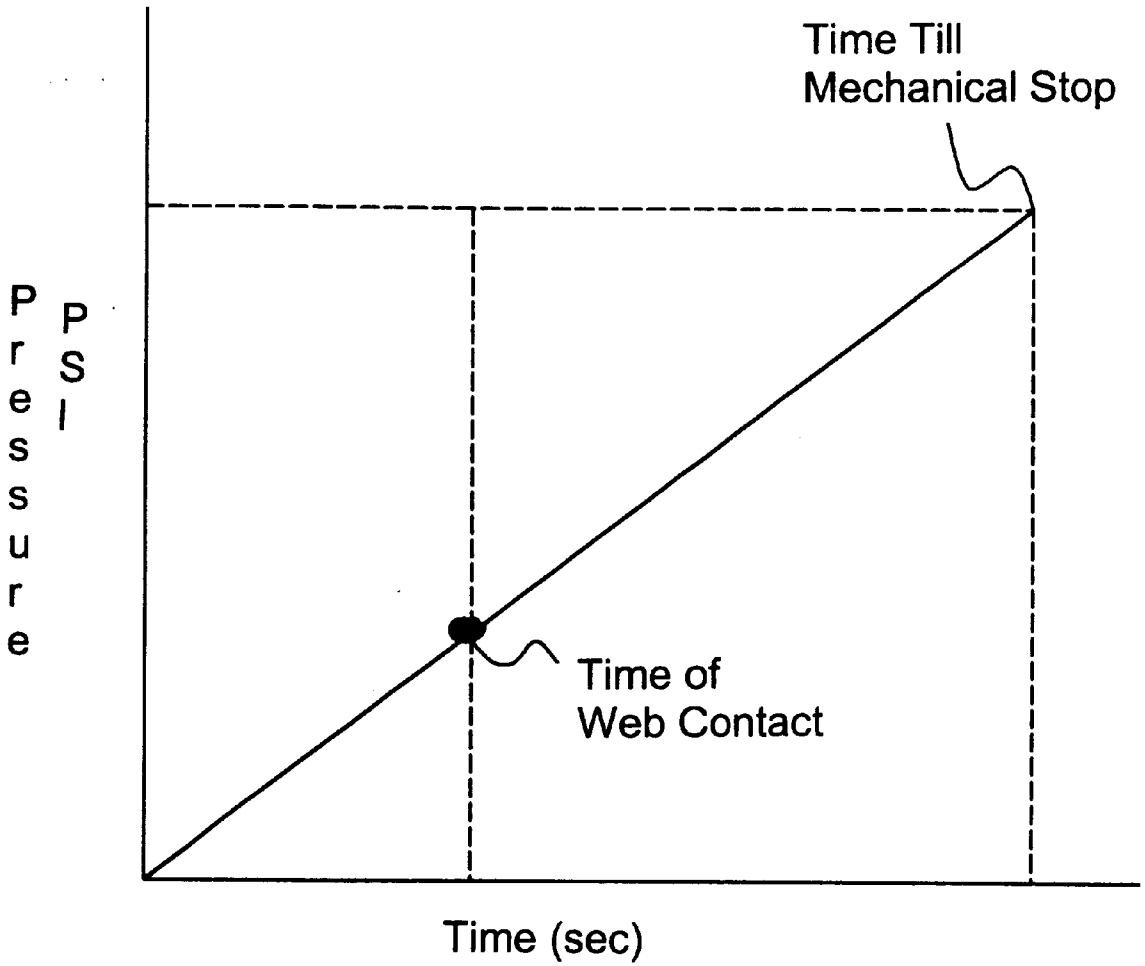
FIG. 2 PRIOR ART
FIG. 2 is a graph correlating a build up of air pressure on one side of an air cylinder and the time till a cutting member strikes a web according the prior art.

FIG. 2 is a graph showing the relationship between the air pressure build up in the first side 9 of the air cylinder 6 and the time required before the cutting member 7 impacts and severs the web 8. As noted in FIG. 2, the cutting member 7 strikes the web 8 before it builds up to its maximum force of 70–90 psi and this can cause the cutting member 7 to drag along the web 8. In addition, the time necessary for building up the pressure also limits the speed of the printing press.

Figure 3:
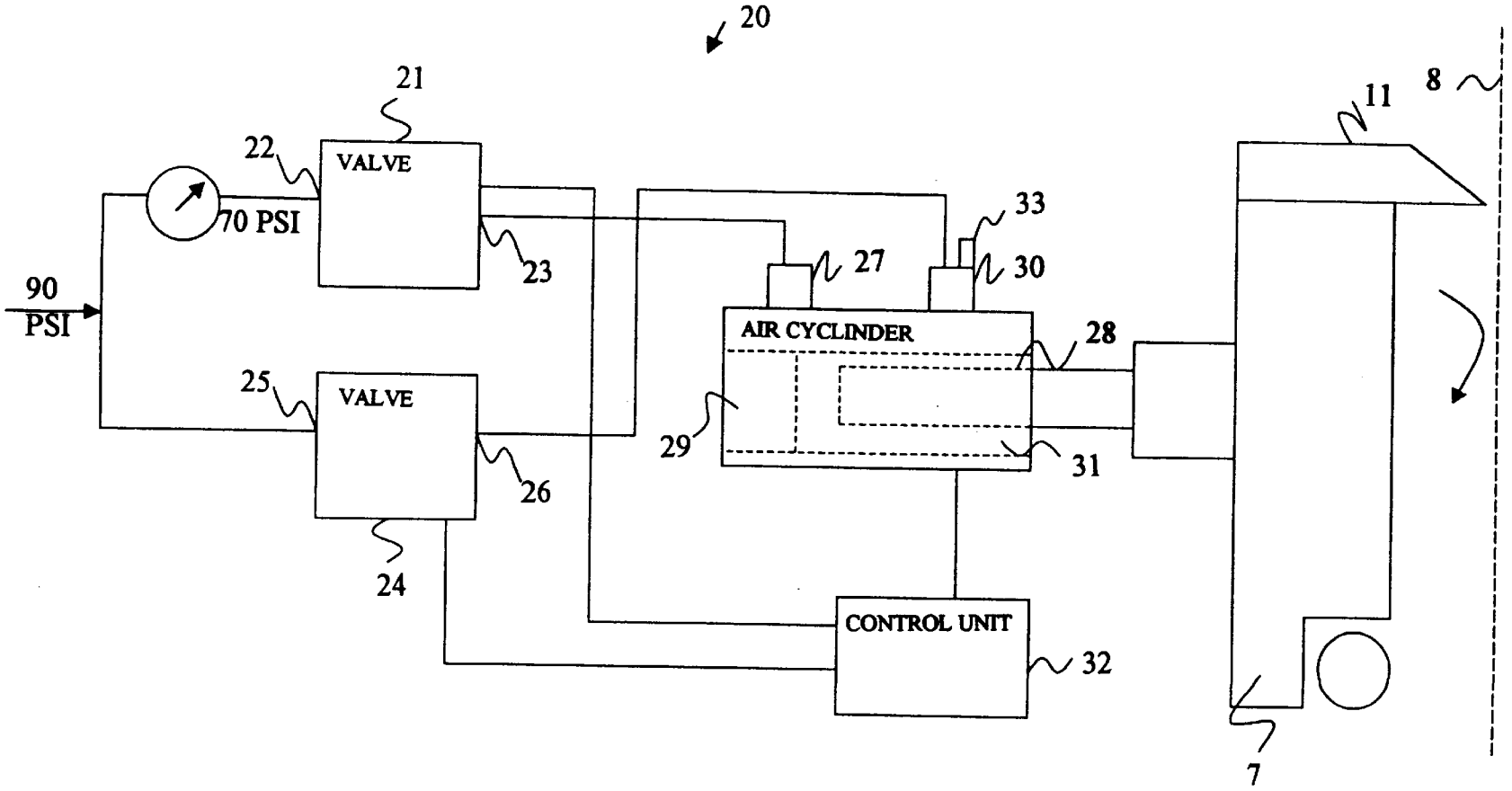
FIG. 3 is a diagrammatic block diagram of a full force web severer according to the invention.

FIG. 3 shows a full force web severer 20 according to the invention. The full force web severer 20 has a first 3-way valve 21 with a pressure inlet 22 and a pressure outlet 23. The web severer 20 also has a second 3-way valve 24 with a pressure inlet 25 and a pressure inlet/outlet 26. The outlet 23 of the first valve 21 is connected to an input 27 of an air cylinder 28 and maintains an air pressure of approximately 70–75 psi in a first side or end 29 of the air cylinder 28. The inlet/outlet 26 of the second valve 24 is connected to an input/outlet 30 of the air cylinder 28 and maintains an air pressure of approximately 90 psi in a second side or end 31 of the air cylinder 28 during a non-cutting state.

Because the pressure in the second end 31 is greater than the first end 29 of the air cylinder 28, the air cylinder does not actuate the cutting member 7 to cut the web 8 (i.e. the non-cutting state). Upon receiving an actuation signal from a control unit 32, the second side 31 of the air cylinder 28 is quickly evacuated by a quick exhaust valve 33 connected to the inlet/outlet 30 of the air cylinder 28. In addition to controlling the air cylinder 28, the control unit 32 can also control the first valve 21 and the second valve 24.

Therefore, the 70–75 psi pressure in the first side 29, moves the cutting member 7 under full force towards the web 8 to be severed. This happens because the pressure in the first side 29 is maintained at full pressure at all times and the pressure build up time necessary in the prior art is avoided. The overall result is that the time to move the cutting member 7 is reduced and a knife 11 of the cutting member is guaranteed to impact the web 8 at full force and reduces the amount of paper 2 that drags over the knife 11 prior to being cut.

When the knife 11 contacts the web 8 the following equations hold true:

$$F=ma \quad (1);$$

and $$F=PA \quad (2);$$

where
F=force,
m=mass of the cutting member 7,
a=acceleration of the cutting member 7,
P=available instantaneous air pressure,
A=area of a cylinder of the air cylinder 28,
X=stroke length of the air cylinder 28 to the web 8, and
t=time of stroke.

Therefore:

$$ma=PA \quad (3);$$

$$mv/t=PA \quad (4);$$

$$mv/A=Pt \quad (5);$$

$$\frac{m}{A}(x/t) = Pt; \quad (6)$$

$$mx/A = Pt^2; \quad \text{and} \quad (7)$$

$$\frac{mx}{AP} = t^2. \quad (8)$$

It is noted that $$mx/A = \frac{\text{(mass) (stroke length to the web)}}{\text{(cylinder area)}}$$

is a constant C. From this it is derived that the time for the cutting member 7 to strike the web 8 is equal to:

$$t = \sqrt{\frac{c}{P}}. \quad (9)$$

Therefore, the greater the pressure, the less time necessary for contact between the cutting member 7 and the web 8.

Figure 4:
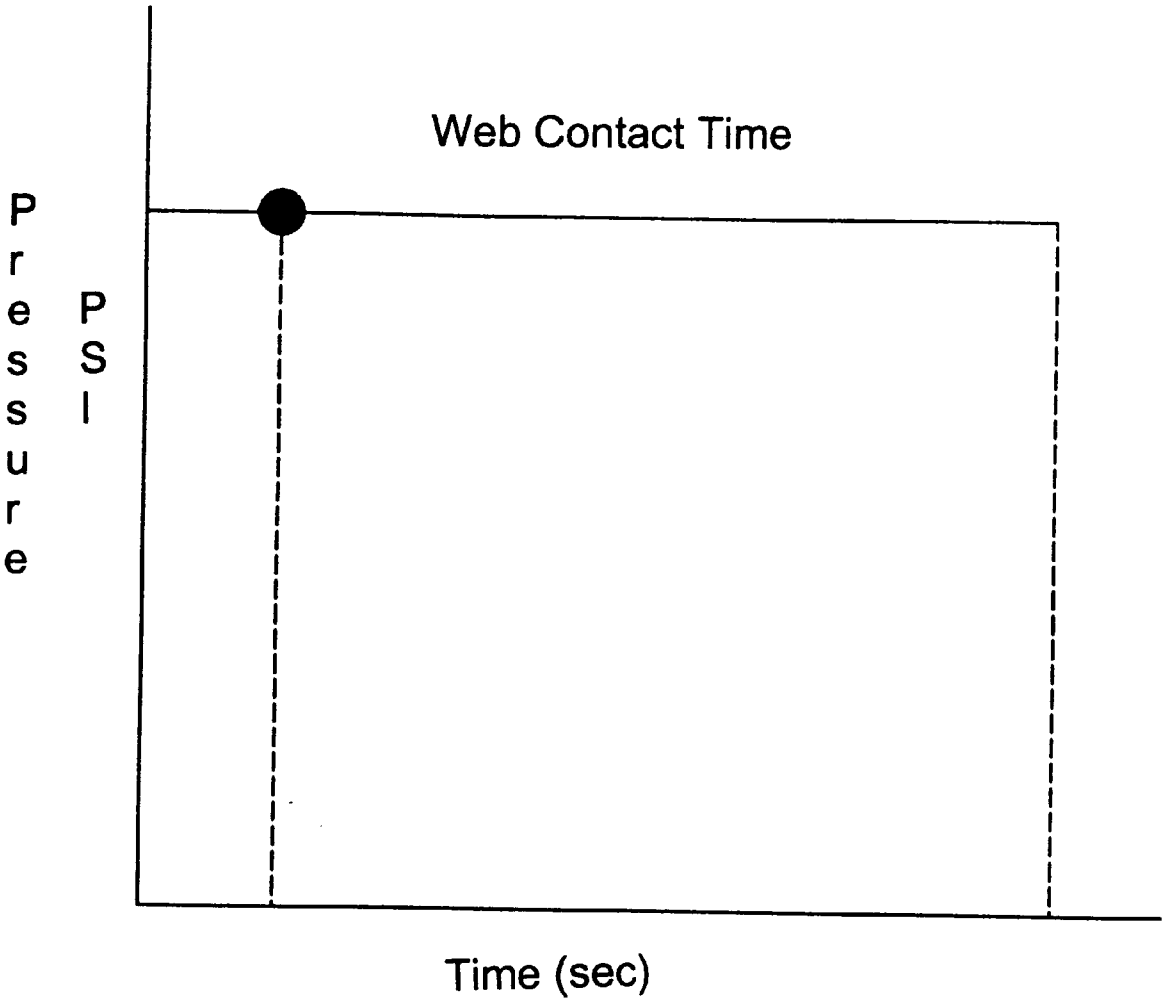
FIG. 4 is a graph correlating the air cylinder air pressure and the time till web contact.

FIG. 4 is a graph showing the reduced time it takes the cutting member 7 to cut the web 8 due to the increase in the initial pressure being in the range of 70–75 psi.

I claim:

1. A method for severing a web, which comprises:

a) providing a first given air pressure during a non-cutting state to a first side of an air pressure cylinder for driving a cutting member under full force towards the web during a cutting state;

b) providing a second given air pressure to a second side of the air pressure cylinder that is greater than the first given air pressure during the non-cutting state of the air cylinder, the cutting member remaining stationary as long as the second given air pressure being greater than the first given air pressure; and c) reducing rapidly the second given air pressure to below the first given air pressure during the cutting state of the air pressure cylinder causing movement of the cutting member to sever a web.

2. The method according to claim 1, which comprises repeating steps b) and c) for each severing operation.

3. The method according to claim 1, which comprises providing a control unit outputting control signals received by the air cylinder for controlling the first given air pressure and the second given air pressure and for transitioning between the cutting state and the non-cutting state.

4. The method according to claim 3, which comprises:

using a first valve for providing the first given air pressure value and a second valve for providing the second given air pressure value; and controlling the first valve and the second valve via the control signals output by the control unit.

5. The method according to claim 4, which comprises providing three-way valves as the first valve and the second valve.

6. The method according to claim 1, wherein the first given air pressure is in a range of 70–75 psi and the second given air pressure is greater than or equal to 90 psi in the non-cutting state.

7. The method according to claim 1, which comprises using a quick exhaust valve for rapidly reducing the second given air pressure during step c).

8. A method for severing a web, which comprises:

a) providing a first given air pressure during a non-cutting state to a first side of an air pressure cylinder for driving a cutting member under full force towards the web during a cutting state;

b) providing a second given air pressure to a second side of the air pressure cylinder that is greater than the first given air pressure during the non-cutting state of the air cylinder, the cutting member remaining stationary as long as the second given air pressure being greater than the first given air pressure;

c) reducing rapidly the second given air pressure to below the first given air pressure by opening a quick exhaust valve during the cutting state of the air pressure cylinder causing movement of the cutting member; and d) providing a control unit controlling the quick exhaust valve and thereby controlling the transitioning between the non-cutting state and the cutting state.

9. The method according to claim 8, which comprises repeating steps b) and c) for each severing operation.

10. The method according to claim 8, which further comprises controlling the first given air pressure with the control unit by controlling a first valve associated with the first given air pressure, and controlling the second given air pressure with the control unit by controlling a second valve associated with the second given air pressure.

11. The method according to claim 10, which comprises:

using a first valve for providing the first given air pressure value and a second valve for providing the second given air pressure value; and controlling the first valve and the second valve via the control signals output by the control unit.

12. The method according to claim 11, which comprises providing three-way valves as the first valve and the second valve.

13. The method according to claim 8, wherein the first given air pressure is in a range of 70–75 psi and the second given air pressure is greater than or equal to 90 psi in the non-cutting state.

14. The method according to claim 8, which comprises using a quick exhaust valve for rapidly reducing the second given air pressure during step c).

* * * * *